US008967824B2

(12) United States Patent
Hootman et al.

(10) Patent No.: US 8,967,824 B2
(45) Date of Patent: Mar. 3, 2015

(54) PORTABLE LIGHT HAVING A MODULAR BASE

(75) Inventors: Charles Hootman, Columbus, OH (US); Paul Harrison, Columbus, OH (US); Abraham Alexander, Columbus, OH (US); Christopher Hawker, Columbus, OH (US); Jessica Ann Moreland, Columbus, OH (US)

(73) Assignee: Charles B. Hootman, Columbus, OH (US)

( * ) Notice: Subject to any disclaimer, the term of this patent is extended or adjusted under 35 U.S.C. 154(b) by 0 days.

(21) Appl. No.: 13/471,905

(22) Filed: May 15, 2012

(65) Prior Publication Data

US 2013/0308306 A1 Nov. 21, 2013

(51) Int. Cl.
*F21L 4/02* (2006.01)
*F21V 33/00* (2006.01)

(52) U.S. Cl.
USPC ..... 362/184; 362/396; 362/397; 362/398; 362/457

(58) Field of Classification Search
USPC ..... 362/396–398, 186, 184, 103, 190–191, 362/374–375, 457–458, 800, 362, 200, 202, 362/197, 208, 249.1, 249.11, 427
See application file for complete search history.

(56) References Cited

U.S. PATENT DOCUMENTS

| | | | | |
|---|---|---|---|---|
| 3,836,766 | A * | 9/1974 | Auerbach | 362/311.14 |
| 6,877,875 | B2 * | 4/2005 | Yu et al. | 362/105 |
| 6,941,583 | B2 * | 9/2005 | Yan | 2/209.13 |
| 2006/0010561 | A1 * | 1/2006 | Arganese | 2/159 |
| 2009/0243495 | A1 * | 10/2009 | Levine | 315/153 |
| 2010/0182772 | A1 * | 7/2010 | Wells | 362/156 |
| 2011/0063825 | A1 * | 3/2011 | Cheng | 362/190 |
| 2011/0282642 | A1 * | 11/2011 | Kruger et al. | 703/27 |
| 2011/0292643 | A1 * | 12/2011 | Chen | 362/183 |

* cited by examiner

*Primary Examiner* — Sharon Payne
*Assistant Examiner* — Naomi M Wolford
(74) *Attorney, Agent, or Firm* — Benesch, Friedlander, Coplan & Aronoff LLP; Thomas Y. Kendrick; Christopher H. Bond

(57) ABSTRACT

Systems and apparatuses are disclosed for a portable light having a modular base. In one embodiment, a portable light having a modular base comprises a housing portion and a modular base portion. The housing portion may comprise a light source, power source, and lens. The modular base portion may comprise a mounting portion, and the modular base portion is configured to removably connect to the housing portion. The housing portion is further configured to operatively connect to the modular base portion through a deformable fabric, such that the housing portion is rotatable relative to the modular base portion when the housing portion is operatively connected to the modular base portion through a deformable fabric.

17 Claims, 8 Drawing Sheets

PORTABLE LIGHT HAVING A MODULAR BASE

BACKGROUND

People often engage in activities wherein a portable light is useful, both for illuminating the object of one's attention, as well as for providing a warning to others that one is present. For example, many people are active during the nighttime for reasons such as their job, exercise, transportation, and maintenance of their property. A portable light may be critical to illuminate the individual's surroundings so as to effectively perform their objective and avoid potential hazards. The use of a handheld light as a signaling device has been common since its inception. For example, a person riding a bicycle or walking along a street at night may opt to employ a portable light to warn drivers to the person's presence, thereby increasing the safety of such activities.

However, various styles of portable lights may not be suitable for more than one role, often as a result of their means of attachment. For example, a portable light primarily configured to be carried in the hand may not be suitable for use during cycling when one needs one's hands to control the bicycle. Likewise, a light configured to be worn about an individual's head may not be suitable for illuminating certain types of dangers, such as those presented by stairs during a power outage. As such, what is needed is a portable light source having a modular design capable of affixing to various bases in various situations.

SUMMARY

In one embodiment, a lighting device is provided, the lighting device comprising: a housing having a first engagement element extending about the housing's outer periphery; a light source; a power source; and a base portion having a second engagement element extending about the base portion's interior, wherein the housing is configured to removably connect to the base portion through a mating between the first engagement element and the second engagement element.

In another embodiment, a light is provided, the light comprising: a housing; a light source; a power source; and a base portion having a mounting portion, wherein the mounting portion includes at least one of a clip, a spring clip, a magnet, a clamp, a suction cup, a hook and loop fastener, and a strap; and wherein the housing is configured to removably connect to the base portion.

In another embodiment, an illuminating device is provided, the illuminating device comprising: a housing having a first engagement element; a light source; and a power source; wherein the housing is configured to removably connect to a base portion.

BRIEF DESCRIPTION OF THE DRAWINGS

The accompanying figures, which are incorporated in and constitute a part of the specification, illustrate various example apparatuses, systems, and methods, and are used merely to illustrate various example embodiments.

DETAILED DESCRIPTION

Figure 1:
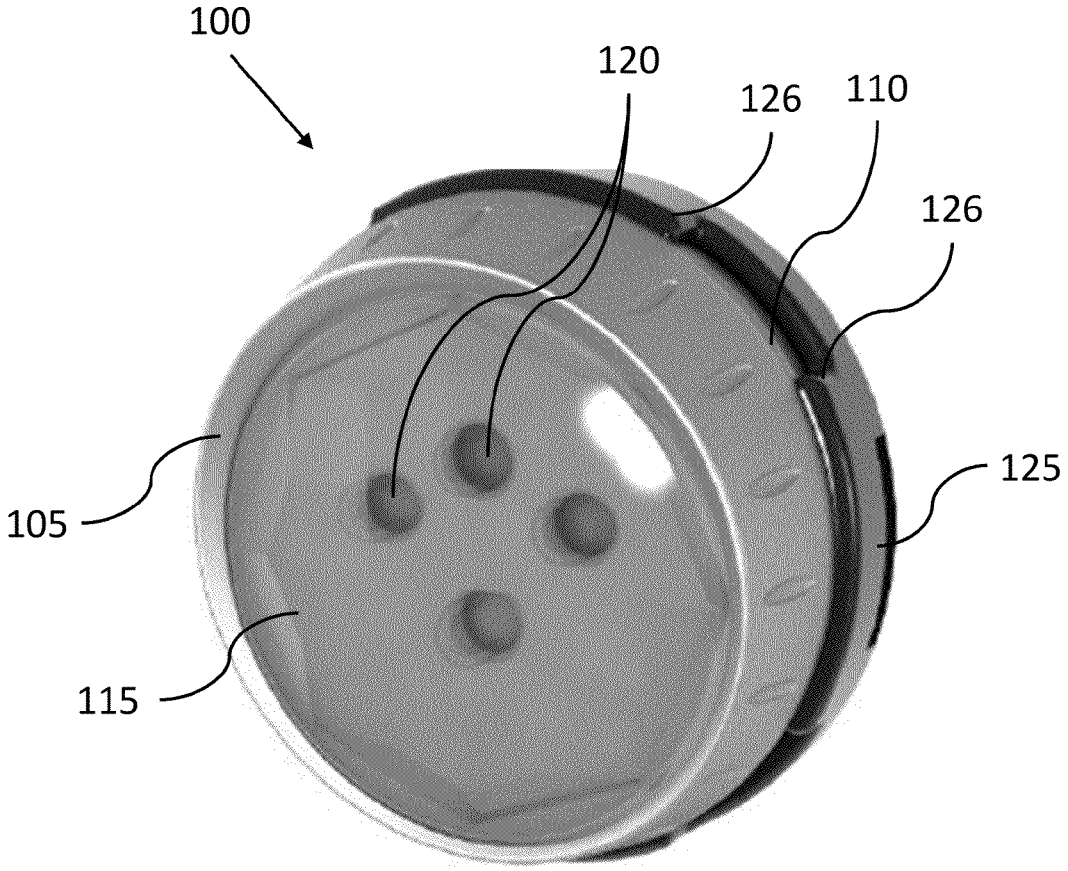
FIG. 1 illustrates an example arrangement of a portable light having a modular base.

FIG. 1 illustrates an example arrangement of a portable light having a modular base 100. Portable light 100 includes a housing 105. In one embodiment, housing 105 includes a first engagement element 110 extending about housing 105's outer periphery. Portable light 100 also includes a lens 115 and a light source 120. Portable light 100 may include a base portion 125.

Housing 105 may have a substantially round profile as illustrated in FIG. 1. Housing 105 may have a profile of any of various shapes, including for example, square, quadrilateral, elliptical, or semi-circular. In another embodiment, housing 105 has any regular or irregular polygonal profile. In one embodiment, housing 105 includes a plurality of grip-enhancing elements about its outer periphery. Grip-enhancing elements may include a series of dimples, raised portions, textured portions, or other elements to enhance a user's grip of housing 105. In one embodiment, housing 105 includes an angled profile, such that the plane of housing 105's front opening and the plane of housing 105's rear opening are not parallel to one another. Such an angled profile allows a user to rotate housing 105 within base portion 125 so as to adjust or alter the direction of light produced by portable light 100. In another embodiment, housing 105 includes a front opening plane and rear opening plane that are parallel to one another. Housing 105 may be formed of a variety of materials, including for example, a metal, an alloy, a polymer, and a composite.

In one embodiment, housing 105 includes a first engagement element 110 extending about housing 105's interior or periphery. As illustrated in FIG. 1, first engagement element 110 may extend about the outer periphery of housing 105. First engagement element 110 may be uninterrupted or interrupted about the periphery of housing 105. First engagement element 110 may be concave or convex relative to housing 105. First engagement element 110 may comprise a raised portion such as a ridge, a recessed portion such as a groove, or both. In one embodiment, first engagement element 110 is interrupted repeatedly about the periphery of housing 105 so as to form a series of notches. In another embodiment, first engagement element 110 is continuous about the periphery of housing 105 so as to form a circumferential groove. In another embodiment, first engagement element 110 is continuous about the periphery of housing 105 so as to form a circumferential groove, which allows housing 105 to rotate relative to base portion 125. In another embodiment, first engagement element 110 includes threads configured to screw onto (e.g., female threads) or into (e.g., male threads) another element.

As illustrated in FIG. 1, portable light 100 may include a lens 115. In one embodiment, lens 115 is a clear lens configured to allow light to pass through with minimal interference. In another embodiment, lens 115 is a colored lens configured to alter the color of light passing through lens 115. Lens 115 may be of any color, including, without limitation, white and red. In one embodiment, lens 115 is configured to focus or alter the path of light passing through lens 115. In another embodiment, lens 115 is adjustable and configured to selectively focus or alter the path of light passing through lens 115. Lens 115 may be configured to provide a wide beam of light (e.g., flood light), a narrow beam of light (e.g., spot light), or a combination of a wide beam of light and narrow beam of light. In one embodiment, lens 115 includes a plurality of layers of material. Lens 115 may be formed of a variety of materials, including for example, a polymer, glass, or a combination of materials. In one embodiment, lens 115 is operatively connected to a switch (not shown), and can be used as a switch activator to turn portable light 100 on and off.

Portable light 100 includes a light source 120. In one embodiment, light source 120 includes a printed circuit board and at least one light-emitting diode. The at least one light-emitting diode may be configured to emit light that is at least one of a substantially white light, a substantially colored light, or a combination thereof. In one embodiment, portable light 100 includes a switch (not shown) configured to control the flow of electricity between a power source (not shown) and the at least one light-emitting diode, so as to allow a user to selectively control the emission of light from the at least one light-emitting diode. In one embodiment, light source 120 and the switch (not shown) are configured to allow the at least one light-emitting diode to emit light in a series of intensities and colors. In another embodiment, light source 120 is configured to cause the at least one light-emitting diode to emit light without interruption. In another embodiment, light source 120 is configured to cause the at least one light-emitting diode to blink intermittently. In another embodiment, a plurality of light-emitting diodes are included in light source 120, and light source 120 and/or the switch (not shown) are configured to selectively control the number of light-emitting diodes emitting light. In one embodiment, light source 120 includes at least one incandescent bulb. In another embodiment, light source 120 is configured to cause the at least one incandescent bulb to emit light without interruption. In another embodiment, light source 120 is configured to cause the at least one incandescent bulb to blink intermittently. In another embodiment, light source 120 includes a plurality of incandescent bulbs, and light source 120 and the switch (not shown) are configured to selectively control the number of incandescent bulbs emitting light.

Portable light 100 may include a base portion 125. Base portion 125 may have a substantially round profile as illustrated in FIG. 1. Base portion 125 may have a profile of any of various shapes, including for example, square, quadrilateral, elliptical, or semi-circular. In another embodiment, base portion 125 has any regular or irregular polygonal profile. In one embodiment, base portion 125 has a profile substantially the same as housing 105. Base portion 125 may be formed of a variety of materials, including for example, a metal, an alloy, a polymer, and a composite.

In one embodiment, base portion 125 includes a second engagement element 126 extending about its interior. In another embodiment, second engagement element 126 may extend about the outer periphery of base portion 125. Second engagement element 126 may be uninterrupted or interrupted about the interior or periphery of base portion 125. Second engagement element 126 may be concave or convex relative to base portion 125. Second engagement element 126 may comprise a raised portion such as a ridge, a recessed portion such as a groove, or both. In one embodiment, second engagement element 126 is interrupted repeatedly about the interior or periphery of base portion 125 so as to form a series of notches. In another embodiment, second engagement element 126 is continuous about the interior or periphery of base portion 125 so as to form a circumferential groove. In another embodiment, second engagement element 126 includes threads configured to screw onto (e.g., female threads) or into (e.g., male threads) another element.

In one embodiment, second engagement element 126 is configured to mate to first engagement element 110, and is configured to facilitate a removable connection between housing 105 and base portion 125. First engagement element 110 and second engagement element 126 may be configured to mate by means of one or more of an interference fit, a twist fit, and a thread engagement. In one embodiment, first engagement element 110 comprises a groove about the periphery of housing 105, and second engagement element 126 comprises a discontinuous ridge about the interior of base portion 125. Second engagement element 126 is formed of a resilient material and configured to deflect enough to allow the ridge of second engagement element 126 to engage the groove of first engagement element 110. In one embodiment, housing 105 and base portion 125 may be capable of being secured to any thin and/or deformable sheet material (e.g., an article of clothing, a thin polymer tarp, a curtain, a sheet, etc.). Such attachment may be accomplished by placing housing 105 on a first side of the thin sheet material, placing base portion 125 on the second side of the thin sheet material, and mating first engagement element 110 and second engagement element 126 to one another with the thin sheet material between. It may not be necessary in some embodiments to perforate the thin sheet material when attaching housing 105 and base portion 125 to a thin sheet material in such a manner. In one embodiment, second engagement element 126 includes a discontinuous ridge or groove, and base portion 125 includes at least one notch in its periphery. The at least one notch is configured to permit base portion 125 and second engagement element 126 to deflect as necessary to securely engage first engagement element 110. In another embodiment, the at least one notch is configured to permit base portion 125 and second engagement element 126 to deflect enough to securely engage first engagement element 110 with a thin and/or deformable fabric or sheet between first engagement element 110 and second engagement element 126. In another embodiment, first engagement element 110 and second engagement element 126 are configured such that a tolerance exists between them such that a thin and/or deformable sheet material may fit between first engagement element 110 and second engagement element 126 when engaged.

In one example embodiment, portable light 100 includes housing 105. Housing 105 is substantially truncated conical and substantially cylindrical in shape. Housing 105 includes at its larger end first engagement element 110, which comprises a groove extending about the periphery of housing 105. Housing 105 includes at its smaller end lens 115. Within housing 105 is contained light source 120, comprising a plurality of light-emitting diodes. Portable light 100 also includes base portion 125, wherein base portion 125 is substantially cylindrical in shape. Base portion 125 includes a plurality of notches about its periphery, as well as a discontinuous second engagement element 126. Second engagement element 126 includes a ridge configured to mate with the groove portion of first engagement element 110. Base portion 125 also includes a back portion (not shown) which is substantially planar and transverse to base portion 125's substantially cylindrical portion.

Figure 2:
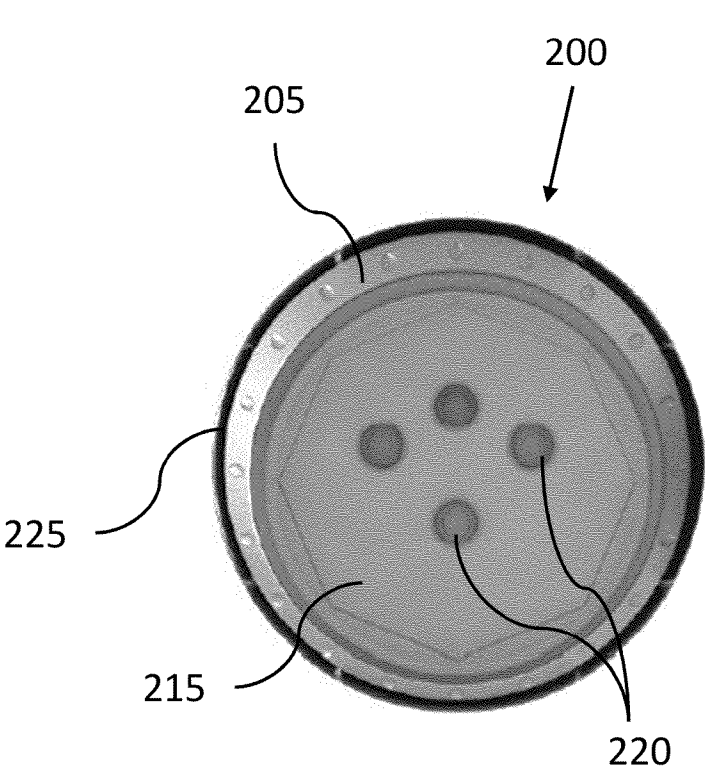
FIG. 2 illustrates an example arrangement of a portable light having a modular base.

FIG. 2 illustrates an example arrangement of a portable light having a modular base 200. Portable light 200 includes a housing 205, a lens 215, a light source 220, and a base portion 225.

Figure 3:
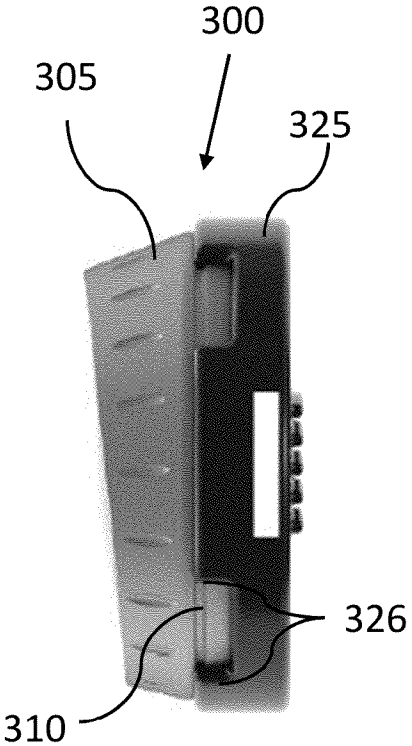
FIG. 3 illustrates an example arrangement of a portable light having a modular base.

FIG. 3 illustrates an example arrangement of a portable light having a modular base 300. Portable light 300 includes a housing 305, a first engagement element 310, and a base portion 325, and a second engagement element 326. As illustrated in FIG. 3, housing 305 includes an angled profile, such that the plane of housing 305's front opening and the plane of housing 305's rear opening are not parallel to one another.

Figure 4:
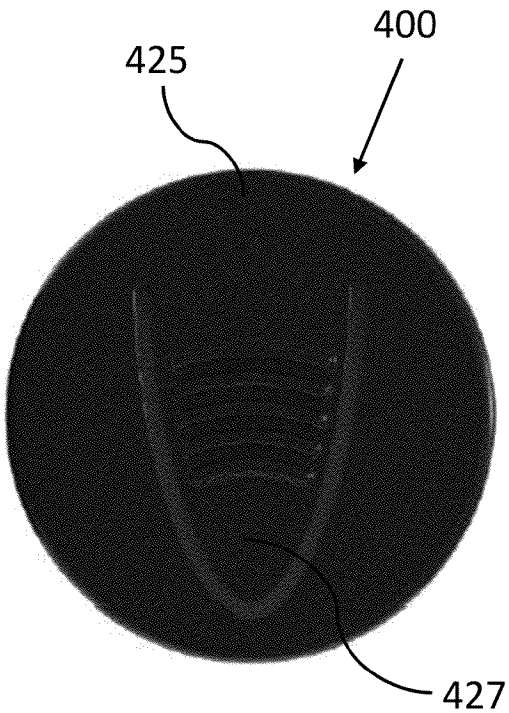
FIG. 4 illustrates an example arrangement of a portable light having a modular base.

FIG. 4 illustrates an example arrangement of a portable light having a modular base 400. Portable light 400 includes a base portion 425 and a mounting portion 427.

Mounting portion 427 can include any of a variety of systems configured to attach base portion 425. For example, it may be desirable to attach base portion 425 to an article of clothing, a helmet, a user's body, a bicycle frame element, a wall, etc. Mounting portion 427 may include a clip as illustrated in FIG. 4. Such a clip may be formed by providing a cut in base portion 425, wherein a section of base portion 425 can be deflected to extend on one side of an object (e.g., a pocket in an article of clothing), while the remainder of base portion 425 remains on the other side of an object.

Mounting portion 427 may additionally include a spring clip comprising two members biased toward one another, which when separated can be placed about an object and released. An example of such a spring clip includes an alligator clip.

In another embodiment, mounting portion 427 includes a magnet configured to attach base portion 425 to a substantially ferrous metal or the like, or to an article containing a substantially ferrous metal or the like.

In another embodiment, mounting portion 427 includes a suction cup configured to attach base portion 425 to a smooth surface.

In another embodiment, mounting portion 427 includes a hook and loop fastener, such that mounting base portion 425 would be fitted with either a hook material or a loop material, while the surface to which a user desires to fix base portion 425 is fitted with the hook or loop mate.

Mounting portion 427 may also include a strap material, configured to tie, cinch, or hang base portion 425 on a user or object. For example, mounting portion 427 may include a strap configured to be secured to a user's wrist, or to any article capable of securing with a strap (e.g., a lamp post, a portion of a bicycle frame, a helmet, etc.). In another example, mounting portion 427 may include a lanyard configured to hang base portion 425 about a user's neck, or about any article capable of supporting base portion 425. The strap may be formed out of any capable material, including a textile, rope, leather, a polymer, a rubber, and metal.

In another embodiment, mounting portion 427 may include an adjustment device configured to adjust base portion 425 relative to the object to which mounting portion 427 is mounted. In one embodiment, mounting portion 427 includes a universal joint allowing for adjustment of base portion 425 about at least two axes of motion. In another embodiment, mounting portion 427 includes a hinge allowing for adjustment of base portion 425 about at least one axis of motion.

Figure 5:
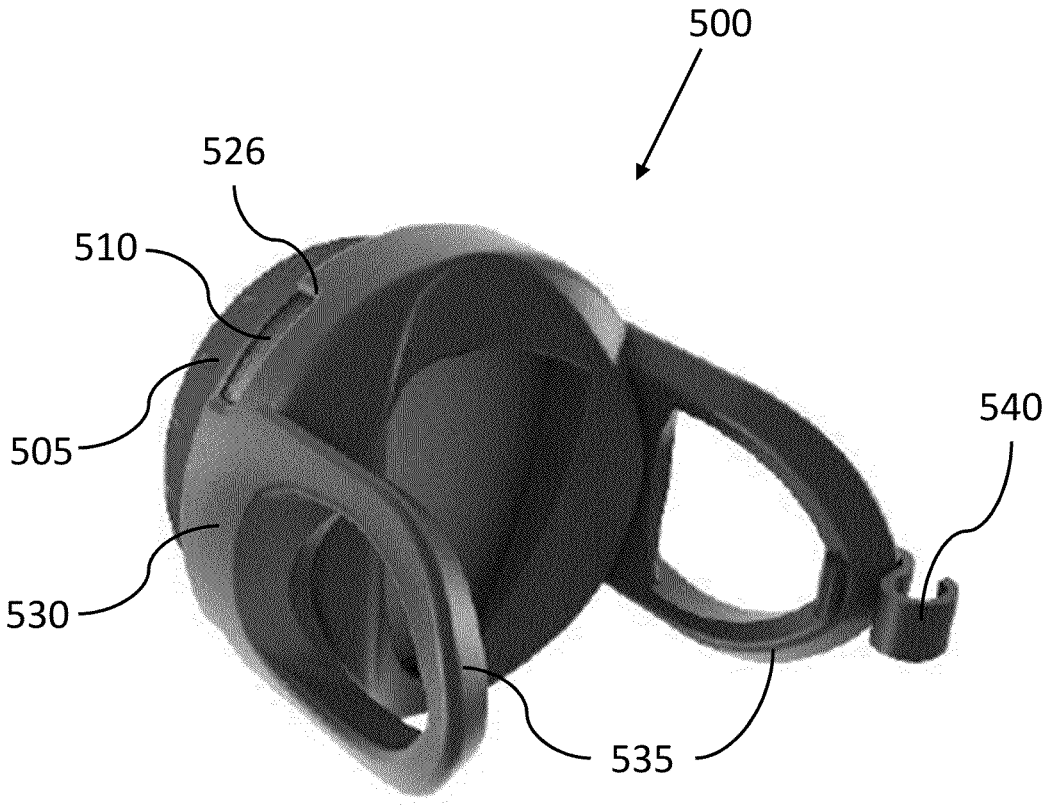
FIG. 5 illustrates an example arrangement of a portable light having a modular base.

FIG. 5 illustrates an example arrangement of a portable light having a modular base 500. Portable light 500 includes a housing 505, a first engagement element 510, a second engagement element 526, a base portion 530, mounting portion 535, and hook 540. Base portion 530 includes flexible mounting portion 535 configured to secure base portion 530 to an object. Mounting portion 535 may be a clamp comprising a first and second clamping member, wherein the first clamping member extends around a first side of an object, the second clamping member extends around the second side of an object, and hook 540 is engaged to connect and secure the first and second clamping members. In one embodiment, mounting portion 535 is formed out of a flexible material. In another embodiment, mounting portion 535 is formed out of a resilient material. Mounting portion 535 may be configured to attach base portion 530 to any object about which the first and second clamping members can extend, including, for example, a member of a bicycle frame.

Figure 6:
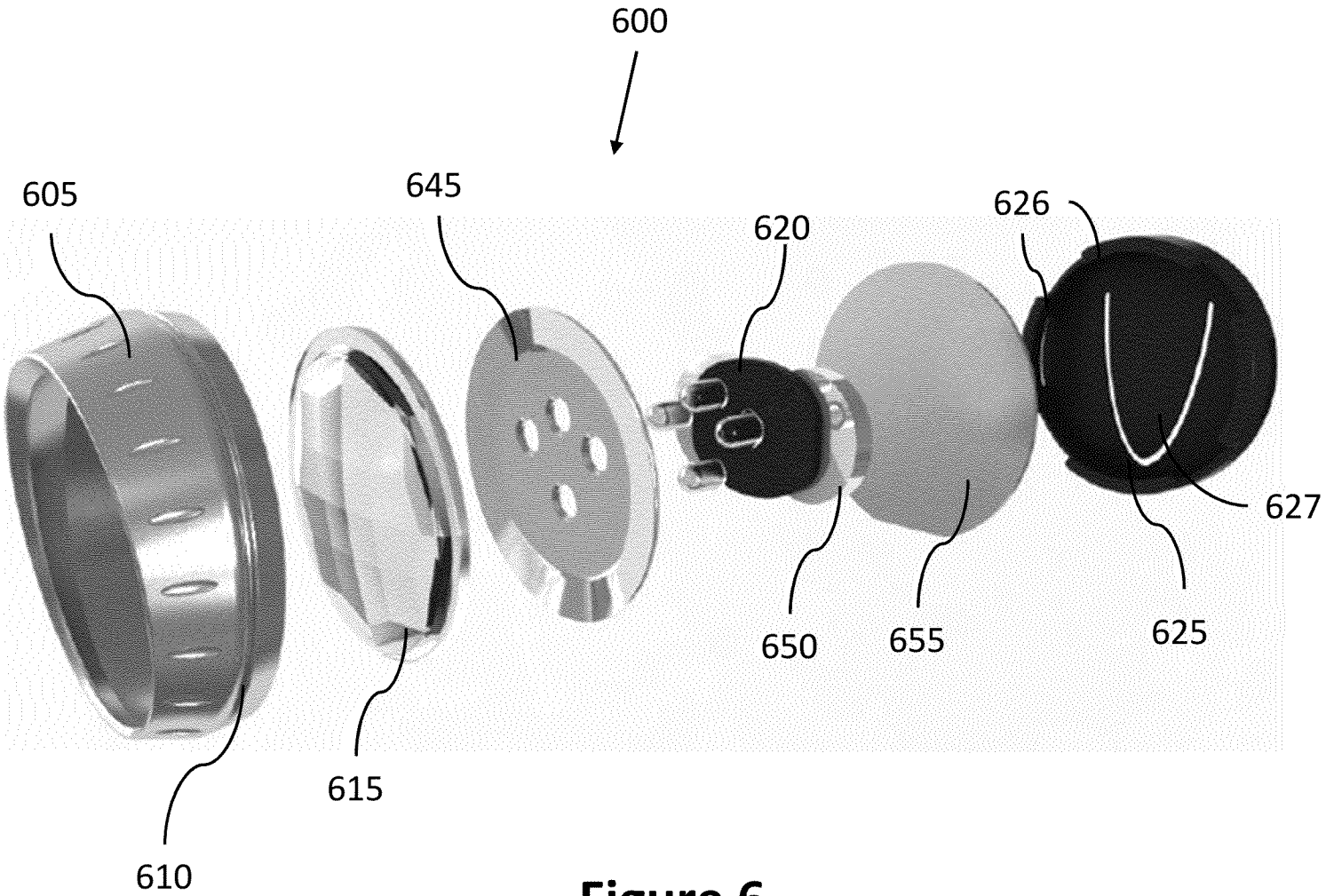
FIG. 6 illustrates an exploded view of an example arrangement of a portable light having a modular base.

FIG. 6 illustrates an exploded view of an example arrangement of a portable light having a modular base 600. Portable light 600 includes a housing 605, a first engagement element 610, a lens 615, a light source 620, a base portion 625, a second engagement element 626, and a mounting portion 627. Portable light 600 further includes a reflector 645, a power source 650, and a back plate 655.

Reflector 645 may include any material having a reflective surface. Reflector 645 is positioned behind the point of creation of light, and is oriented to reflect light toward the lens. In one embodiment, reflector 645 includes a plurality of holes configured to allow light-emitting diodes or incandescent bulbs from light source 620 to extend through reflector 645. Light is created within the light-emitting diode or incandescent bulb, which is situated between reflector 645 and lens 615. Light created by the light-emitting diode or incandescent bulb that is directed toward reflector 645 will be at least partially reflected back toward lens 615 and out of portable light 600.

Power source 650 may include any device capable configured to supply an electrical current to light source 620. In one embodiment, power source 650 is a battery. In another embodiment, power source 650 is a generator. In another embodiment, power source 650 is electricity provided by the power grid. In another embodiment, power source 650 is a solar cell. In another embodiment, power source 650 is a combination of any of the items listed above. In one embodiment, power source 650 is configured to direct power to a switch (not shown), which controls the flow of current to light source 620.

Back plate 655 may be configured to attach to the rear of housing 605 and contain at least one of lens 615, reflector 645, light source 620, and power source 650 within housing 605. In one embodiment, back place 655 is permanently attached to housing 605. In another embodiment, back plate 655 is removably attached to housing 605.

Figure 7:
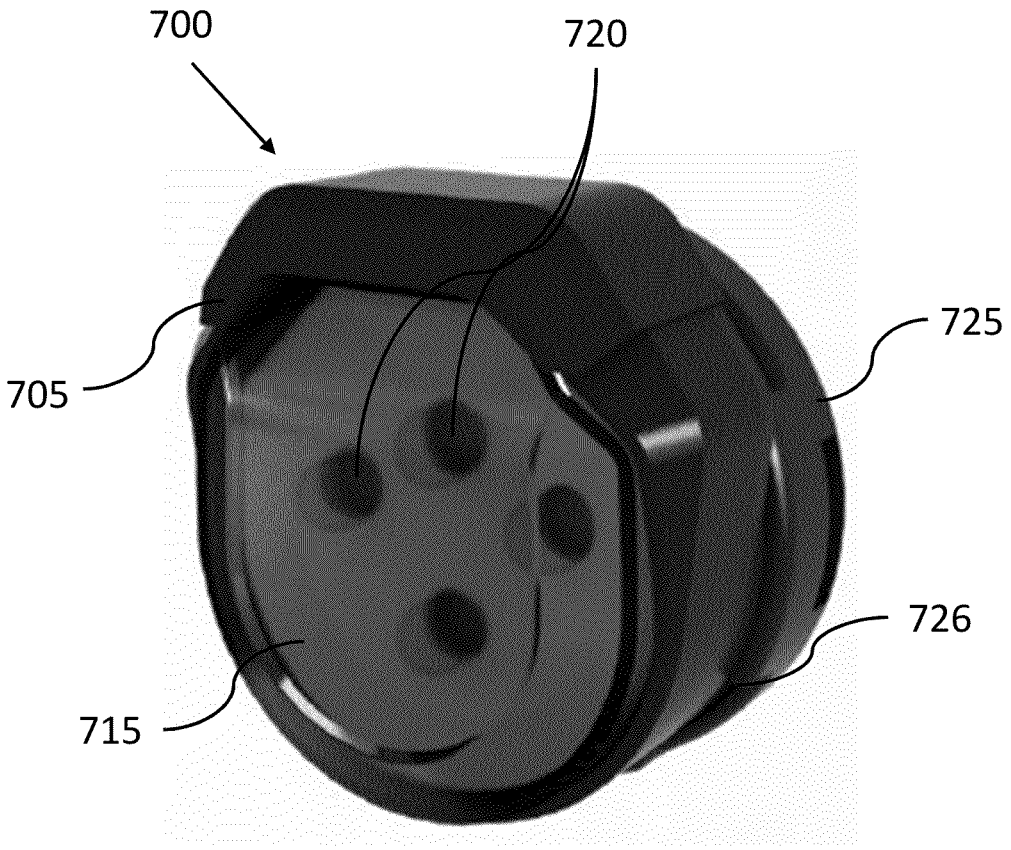
FIG. 7 illustrates an example arrangement of a portable light having a modular base.

FIG. 7 illustrates an example arrangement of a portable light having a modular base 700. Portable light 700 includes a housing 705, a lens 715, a light source 720, a base portion 725, and a second engagement element 726.

In one example embodiment, portable light 700 includes housing 705. Housing 705 includes at its proximal end first engagement element (not shown), which comprises a groove extending about the periphery of housing 705. Housing 705 includes at its distal end lens 715. Within housing 705 is contained light source 720, comprising a plurality of light-emitting diodes. Portable light 700 also includes a base portion 725, wherein base portion 725 is substantially cylindrical in shape. Base portion 725 includes a plurality of notches about its periphery, as well as a discontinuous second engagement element 726. Second engagement element 726 includes a ridge configured to mate with the groove portion of first engagement element (not shown). Base portion 725 also includes a back portion (not shown) which is substantially planar and transverse to base portion 725's substantially cylindrical portion.

Figures 8, 9, 10:
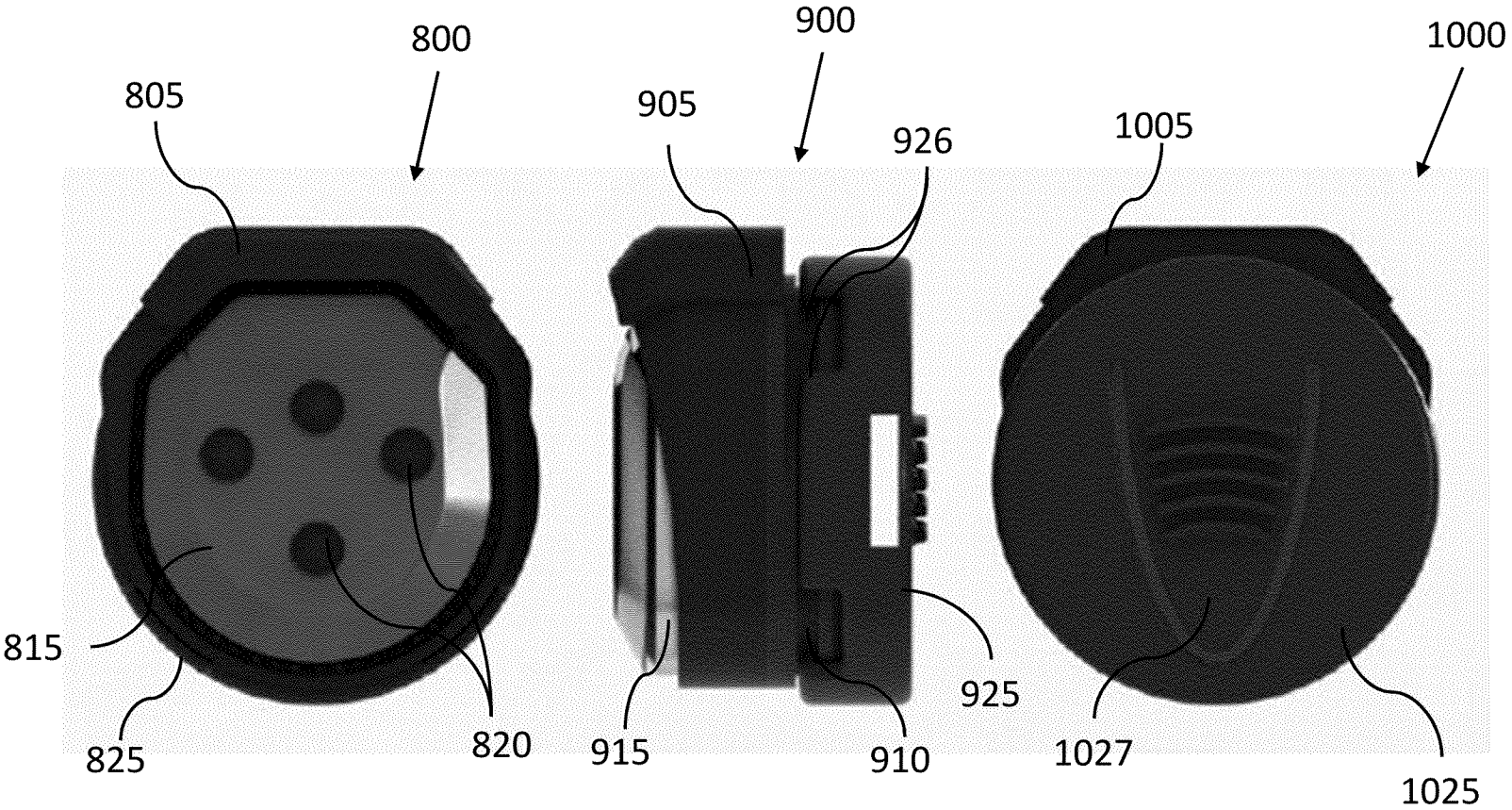
FIG. 8 illustrates an example arrangement of a portable light having a modular base.
FIG. 9 illustrates an example arrangement of a portable light having a modular base.
FIG. 10 illustrates an example arrangement of a portable light having a modular base.

FIG. 8 illustrates an example arrangement of a portable light having a modular base 800. Portable light 800 includes a housing 805, a lens 815, a light source 820, and a base portion 825.

FIG. 9 illustrates an example arrangement of a portable light having a modular base 900. Portable light 900 includes a housing 905, a first engagement element 910, a lens 915, a base portion 925, and a second engagement element 926.

FIG. 10 illustrates an example arrangement of a portable light having a modular base 1000. Portable light 1000 includes a housing 1005, a base portion 1025, and a mounting portion 1027.

Figure 11:
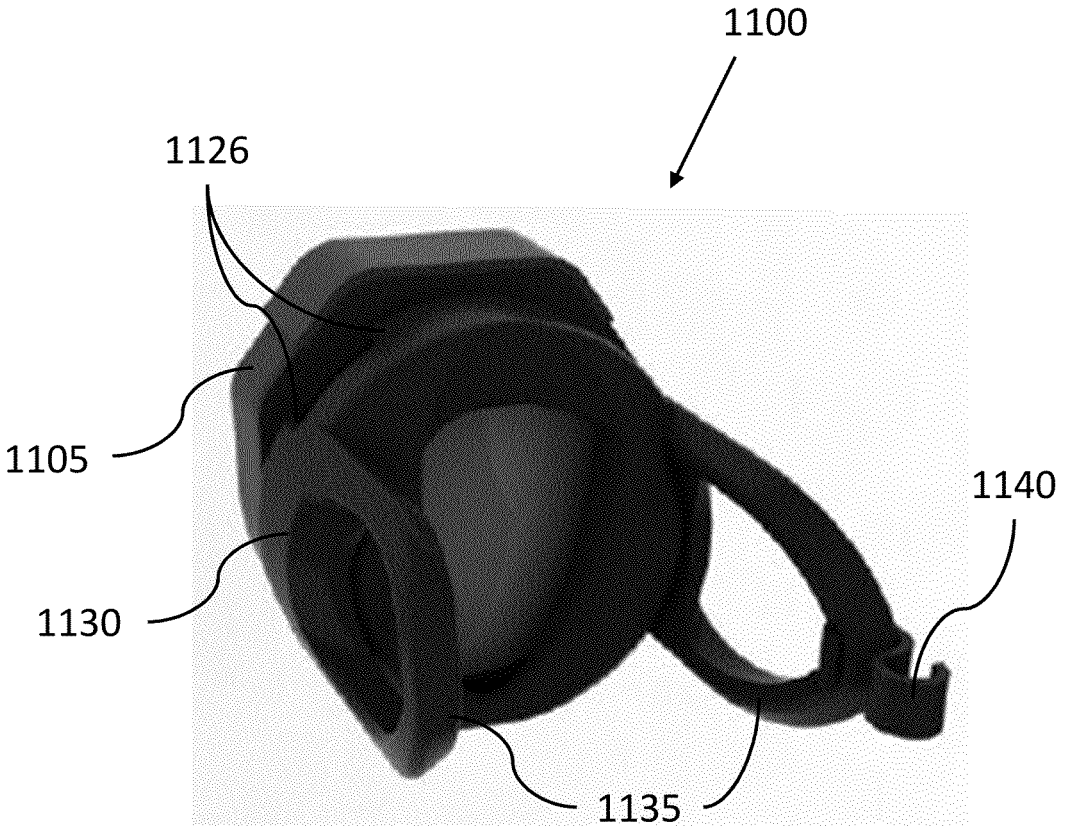
FIG. 11 illustrates an example arrangement of a portable light having a modular base.

FIG. 11 illustrates an example arrangement of a portable light having a modular base 1100. Portable light 1100 includes a housing 1105, a second engagement element 1126, a base portion 1130, mounting portion 1135, and hook 1140. Base portion 1130 includes flexible mounting portion 1135 configured to secure base portion 1130 to an object.

Figure 12:
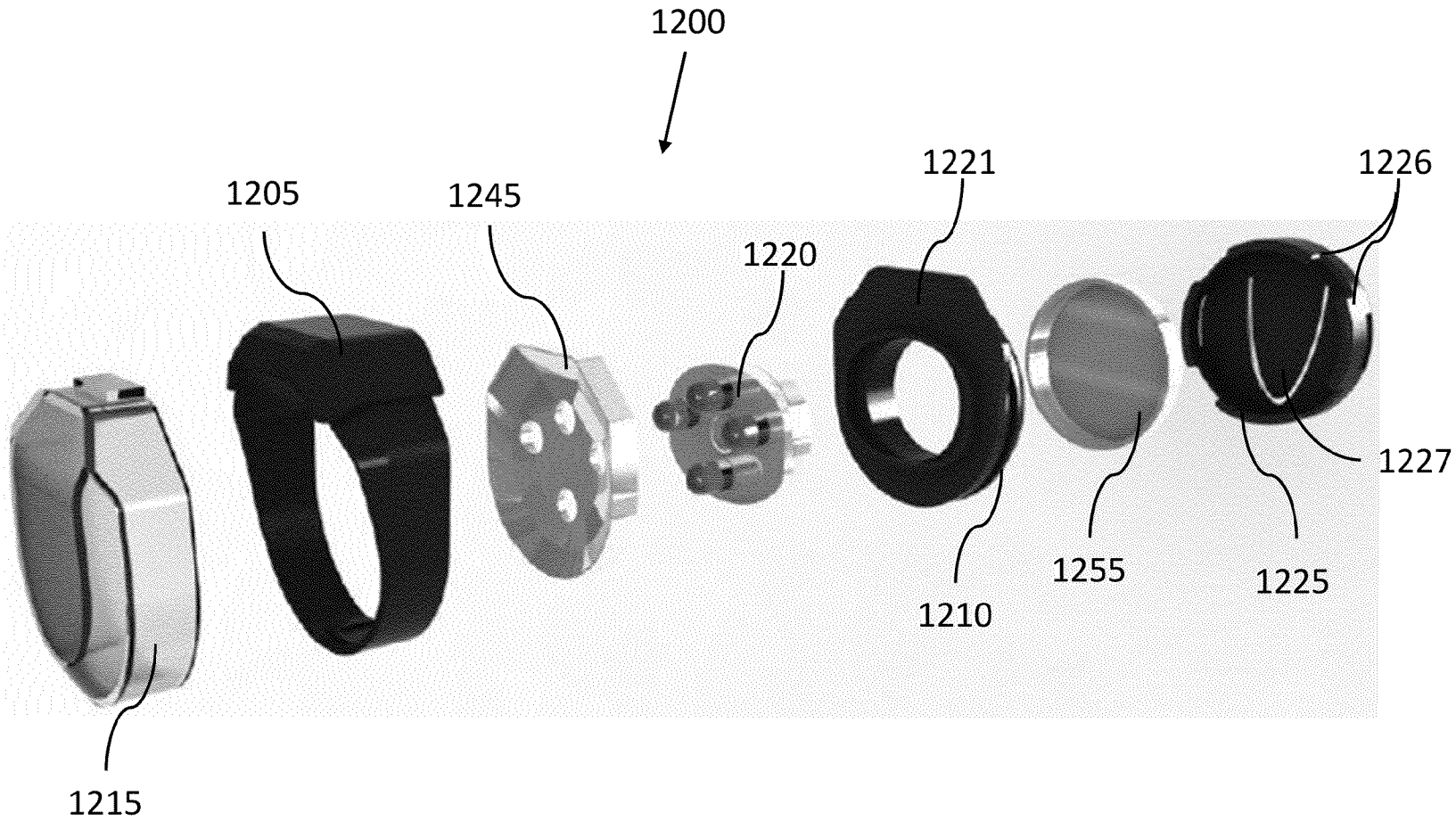
FIG. 12 illustrates an exploded view of an example arrangement of a portable light having a modular base.

FIG. 12 illustrates an exploded view of an example arrangement of a portable light having a modular base 1200. Portable light 1200 includes a housing 1205, a first engagement element 1210, a lens 1215, a light source 1220, a light source cover 1221, a base portion 1225, a second engagement element 1226, and a mounting portion 1227. Portable light 1200 further includes a reflector 1245 and a back plate 1255. In one embodiment, portable light 1200 includes a power source (not shown), which is operatively connected to light source 1220.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See Bryan A. Garner, A Dictionary of Modern Legal Usage 624 (2d. Ed. 1995). Also, to the extent that the terms "in" or "into" are used in the specification or the claims, it is intended to additionally mean "on" or "onto." To the extent that the term "selectively" is used in the specification or the claims, it is intended to refer to a condition of a component wherein a user of the apparatus may activate or deactivate the feature or function of the component as is necessary or desired in use of the apparatus. To the extent that the term "operatively connected" is used in the specification or the claims, it is intended to mean that the identified components are connected in a way to perform a designated function. As used in the specification and the claims, the singular forms "a," "an," and "the" include the plural. Finally, where the term "about" is used in conjunction with a number, it is intended to include ±10% of the number. In other words, "about 10" may mean from 9 to 11.

As stated above, while the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art, having the benefit of the present application. Therefore, the application, in its broader aspects, is not limited to the specific details, illustrative examples shown, or any apparatus referred to. Departures may be made from such details, examples, and apparatuses without departing from the spirit or scope of the general inventive concept.

What is claimed is:

1. A lighting device, comprising:

(1) a housing portion comprising:
a light source;
a power source;
a lens; and a first engagement element comprising at least one of:
a bump,
a groove, the first engagement element extending circumferentially around an outer periphery of the housing;

(2) a modular base portion having a second engagement element comprising at least one of:
a bump,
a groove, the second engagement element extending circumferentially around an inner periphery of the modular base portion;

wherein the housing portion is configured to removably connect to the modular base portion through a mating between the first engagement element and the second engagement element, such that the housing portion is fully separable from the modular base portion, wherein the first engagement element of the housing portion of the second engagement element of the modular base portion are configured to engage one another through a deformable fabric such that the housing portion is on a first side of the deformable fabric and the base portion is on a second side of the deformable fabric, wherein the housing portion is rotatable relative to the modular base portion when the housing portion is operatively connected to the modular base portion through the deformable fabric.

2. The lighting device of claim 1, wherein the light source comprises a printed circuit board and at least one light-emitting diode.

3. The lighting device of claim 2, wherein the light-emitting diode emits light that is at least one of substantially white or colored.

4. The lighting device of claim 1, wherein the light source comprises an incandescent bulb.

5. The lighting device of claim 1, wherein the power source is configured to supply an electrical current to the light source, and wherein the power source comprises a battery.

6. The lighting device of claim 1, wherein the modular base portion further comprises a mounting portion.

7. The lighting device of claim 6, wherein the mounting portion includes at least one of a clip, a spring clip, a magnet, a clamp, a suction cup, a hook and loop fastener, and a strap.

8. A light, comprising:

(1) a housing portion comprising:
a light source;
a power source;
a lens; and (2) a modular base portion having a mounting portion,
wherein the mounting portion includes at least one of a clip, a spring clip, a magnet, a clamp, a suction cup, a hook and loop fastener, and a strap; and wherein the housing portion is configured to removably connect to the modular base portion at an engagement portion comprising at least one of:
a bump
a groove, the engagement portion extending circumferentially around an outer periphery of the housing portion, such that the housing portion is fully separable from the modular base portion, such that the housing portion is operatively connectable to the modular base portion, wherein the housing portion and the modular base portion are configured to operatively connect through a deformable fabric such that the housing portion is on a first side of the deformable fabric and the modular base portion is on a second side of the deformable fabric, wherein the housing portion is rotatable relative to the modular base portion when the housing portion is operatively connected to the modular base portion through the deformable fabric.

9. The light of claim 8, wherein the light source comprises a printed circuit board and at least one light-emitting diode.

10. The light of claim 9, wherein the light-emitting diode emits light that is at least one of substantially white or colored.

11. The light of claim 8, wherein the light source comprises an incandescent bulb.

12. The light of claim 8, wherein the power source is configured to supply an electrical current to the light source, and wherein the power source comprises a battery.

13. An illumination device, comprising:

a housing portion comprising:

a light source;

a power source;

a lens; and a first engagement element comprising at least one of:

a bump, a groove, the first engagement element extending circumferentially around an outer periphery of the housing, wherein the housing portion is configured to removably connect via the first engagement element to a modular base portion, such that the housing portion is fully separable from the modular base portion, such that the housing portion is operatively connectable to the modular base portion, wherein the first engagement element of the housing portion and the modular base portion are configured to engage one another through a deformable fabric such that the housing portion is on a first side of the deformable fabric and the base portion is on a second side of the deformable fabric, wherein the housing portion is fully rotatable relative to the modular base portion when the housing portion is operatively connected to the modular base portion through the deformable fabric, and wherein the lens is operatively connected to a switch for controlling actuation of the light source such that actuation of the lens actuates the light source.

14. The illuminating device of claim 13, wherein the modular base portion further comprises a mounting portion that includes at least one of a clip, a spring clip, a magnet, a clamp, a suction cup, a hook and loop fastener, and a strap.

15. The illuminating device of claim 13, wherein the light source comprises a printed circuit board and at least one light-emitting diode.

16. The illuminating device of claim 15, wherein the light-emitting diode emits light that is at least one of substantially white or colored.

17. The illuminating device of claim 13, wherein the power source is configured to supply an electrical current to the light source, and wherein the power source comprises a battery.

* * * * *